US005684280A

United States Patent [19]

Franz et al.

[11] Patent Number: 5,684,280

[45] Date of Patent: Nov. 4, 1997

[54] DEVICE FOR SWITCHING AN ELECTRIC MOTOR, PARTICULARLY FOR BRAKING AN ELECTRICALLY OPERTED TOOL

[75] Inventors: Herbert Franz, Alzenau; Peter Krebs, Mömbris, both of Germany

[73] Assignee: Heinrich Kopp AG, Kahl, Germany

[21] Appl. No.: 565,660

[22] Filed: Nov. 29, 1995

[30] Foreign Application Priority Data

Dec. 19, 1994 [DE] Germany ..... 44 45 339.6

[51] Int. Cl.[6] ..... H01H 15/00; H01H 1/22

[52] U.S. Cl. ..... 200/16 R; 200/244

[58] Field of Search ..... 200/16 R, 244

[56] References Cited

U.S. PATENT DOCUMENTS

| | | | |
|---|---|---|---|
| 2,838,622 | 6/1958 | Bachi . | |
| 2,960,590 | 11/1960 | Kussmaul et al. | 200/256 |
| 3,221,131 | 11/1965 | Bury . | |
| 3,708,643 | 1/1973 | Erickson | 200/48 KB |
| 5,508,485 | 4/1996 | Nishikawa | 200/525 |

FOREIGN PATENT DOCUMENTS

| | | |
|---|---|---|
| 3 21 413 | 5/1920 | Germany . |
| 35 11 893 A1 | 10/1986 | Germany . |
| 39 40 849 A1 | 5/1990 | Germany . |
| 42 27 719 A1 | 6/1993 | Germany . |
| 42 25 287 A1 | 2/1994 | Germany . |
| 42 32 402 A1 | 3/1994 | Germany . |

*Primary Examiner*—Stuart N. Hecker

*Attorney, Agent, or Firm*—Skjerven, Morrill, MacPherson, Franklin & Friel LLP; Alan H. MacPherson; Thomas S. MacDonald

[57] ABSTRACT

A device for switching an electric motor, particularly for braking an electrically operated tool, comprises change-over switches 19' and 20' for connecting and disconnecting the electric motor to and from an associated power source, for reversing the polarity of a field winding or armature winding of the electric motor, and for enabling and disabling an electric braking circuit for the electric motor, also an actuating member 21' for the change-over switches 19', 20', a movable contact 32', which is associated with each change-over switch and is movable between a fixed ON contact 30' and an OFF contact 30, which is spaced an arcproof distance from said ON contact, and a sliding guide 40', which is associated with at least one movable contact 32' and is adapted to guide said movable contact over at least part of its path of movement during the switching operation. The actuating member consists of a switching slider 21', which cooperates with a toggle lever 54. Tension springs 60 linked to the toggle lever engage at their other end a pivoted lever 27' for moving the movable contact 32'. During the movement of the toggle lever 54 the springs 60, 61 are extended and are pivotally moved beyond a neutral position defined by the hinge 42' for the pivoted lever 27 so that a sudden switching operation is performed.

24 Claims, 7 Drawing Sheets

DEVICE FOR SWITCHING AN ELECTRIC MOTOR, PARTICULARLY FOR BRAKING AN ELECTRICALLY OPERTED TOOL

BACKGROUND OF THE INVENTION

1. Field of the Invention

This invention relates to a device for switching an electric motor, particularly for braking an electrically operated tool.

It is an object of the invention to provide a braking switch for tools which are operated by an electric motor, and it is desired to provide for the use of suitable contacting means, particularly in switches having housings dimensioned in accordance with European standards.

2. Description of the Prior Art

For an electric braking of an electric motor, two change-over switches are required to connect the motor to the electric main supply system or to another power source, to reverse the polarity of a field winding or armature winding of the electric motor, and to enable or disable an electric braking circuit. In the previous practice a off, particularly a fast switching off, had the disadvantage that an undesired electric arc might form between the two fixed contacts over which the power is supplied. That electric arc is due to the contact-breaking spark and to the reversal of the inductances. As a result of that electric arc the field winding of the motor is short-circuited, and the current is now limited only by the armature winding. The current is so strong that a back-up fuse is often blown. Another critical aspect which necessitates an improvement is the fact that when the motor is turned on during the braking operation, an electric arc is also formed between the power supply contacts, resulting in similar consequences described hereinbefore.

Previously known switches for initiating an electric braking comprise either two contact bridges for a double interruption or two toggle switch contacts, which does not permit a sufficiently large contact clearance so that sparkovers and, in addition, contact welding result. Sparking over is also promoted by an excessively fast switching.

SUMMARY OF THE INVENTION

It is an object of the invention to provide for the initiation of an electric braking of an electric motor, particularly for electrically operated tools, a device which ensures stable switching positions and in which special design features are adopted by which the risk of sparkovers, electric arcs, and contact welding is dinstinctly decreased.

This is accomplished in accordance with the invention by the features stated in claim 1. Preferred further features of the invention are apparent from the dependent claims.

The invention desirably provides for the switching of an electric motor, particularly for an electric braking of an electrically operated tool, a device which comprises a change-over switch for connecting and disconnection the electric motor to and from an associated power source and for reversing the polarity of a field winding or armature winding of the electric motor, also a change-over switch for enabling and disabling an electric braking circuit for the electric motor, an actuating member for the change-over switches, a movable contact for each change-over switch, which movable contact is movable between a fixed ON contact and an OFF contact, which is spaced an arcproof distance from said ON contact, and means which are adapted to guide at least one movable contact at least over part of its path of movement during its switching movement.

According to the concept of the invention the ON and OFF contacts are spaced an arcproof distance apart so that a formation of electric arcs with their undesirable results will be avoided during the switching operation. The larger contact clearance increases also the switching time.

According to a preferred feature of the invention the actuating member is linked to both movable contacts. According to a first alternative the actuating member is connected to each movable contact by a spring and the arrangement is preferably such that the actuating member is pivoted to a toggle lever, which is connected to each movable contact by a tension spring. The springs desirably ensure a high contact pressure and will switch the movable contacts in response to an actuation of the actuating member.

Alternatively a contact pressure spring is provided for each movable contact, and for avoiding contact welding. It will be particularly desirable to arrange at least one movable contact such that the movable contact is lifted against the action of that contact pressure spring during the switching operation, by the guiding means from the fixed contact previously engaged by said movable contact, optionally after said movable contact has performed a wiping movement on said fixed contact.

According to a preferred feature, each guiding means has a simple structure comprising a sliding guide for the movable contact and said sliding guide may preferably be limited by a cam face for effecting a fast switching. The sliding guide preferably consists of a sliding rib, desirably ensures that the movable contact can properly engage the desired fixed contact, and a certain distance is then still available for a wiping movement of the contact. Alternatively, the cam face can define during the switching operation a neutral position, which ensures that the critical phase of the contact-opening or contact-closing movement can quickly be overcome.

According to a preferred feature of the invention the movable contact is provided on a pivoted lever, preferably on one side of that lever, said lever is mounted to have a backlash and is preferably rotatable and displaceable, and said mounting means are preferably so designed that the pivoted lever is rotatably mounted with a lateral backlash in a slot. In that case a safe and reliable kinematic switching system may be provided which is extremely simple and comprises only a few parts.

According to a further feature of the invention the pivoted lever comprises a plastic part provided with a sliding rib for cooperating with the sliding guide and at least one guiding means is preferably formed on one side of a housing for the change-over switch.

In a device comprising a toggle lever, that toggle lever may be formed with at least one sliding guide for the movable contact.

A concept which is space-saving and functionally desirable will particularly be obtained if the two change-over switches are symmetrically arranged in a single housing in separate chambers and the actuating member consists of a switching slider, which is arranged to impart a pivotal movement to the movable contacts if the contact pressure spring or the tension spring associated with each movable contact bears on the switching lever or the toggle lever and the switching slider is movably mounted in the housing adjacent to a wall by which the two housing chambers containing the change-over switches are separated.

DETAILED DESCRIPTION OF THE PREFERRED EMBODIMENTS

Further details, features, and advantages of the invention will become apparent from the following detailed description of illustrative embodiments of the invention with reference to the accompanying drawings.

Figure 1:
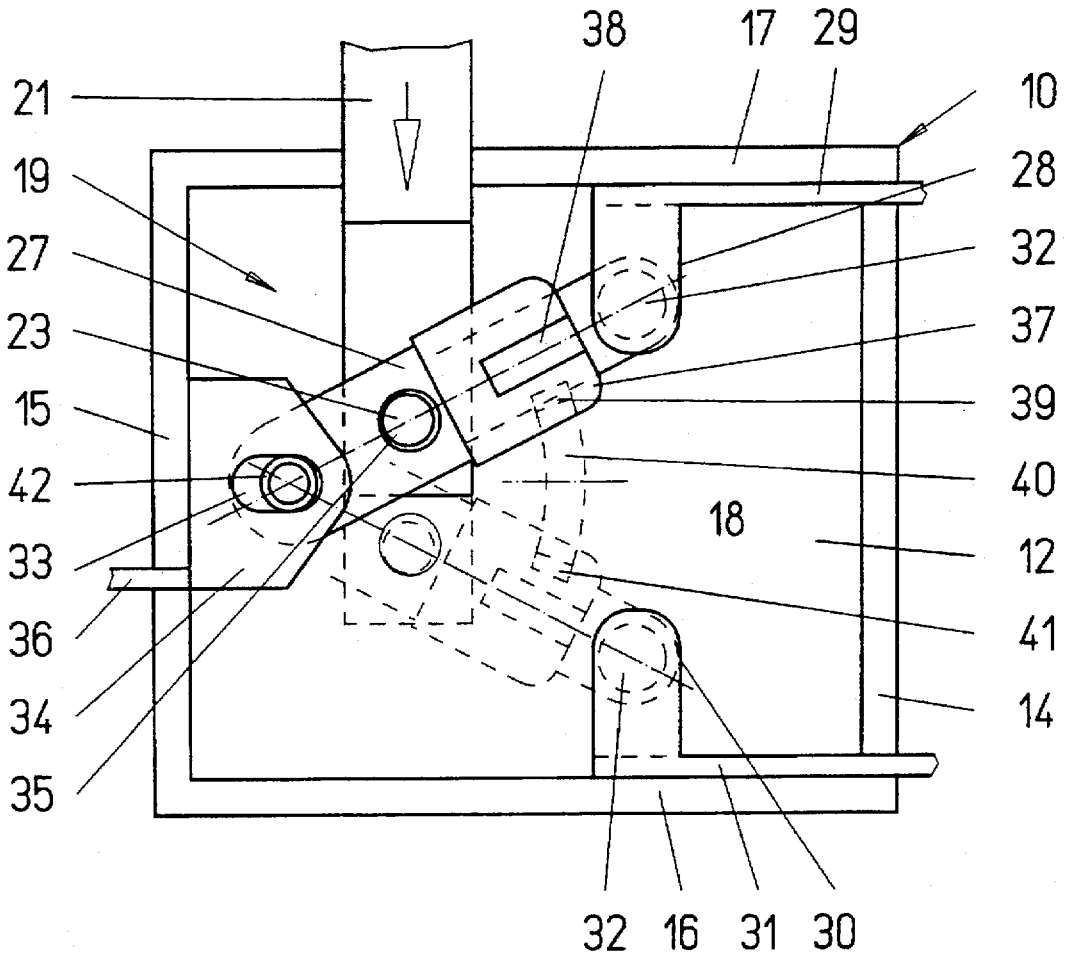
FIG. 1 is a partly schematic representation showing a device in accordance with the invention in a position in which the electric motor is disconnected from an associated electric power source.
Figure 3:
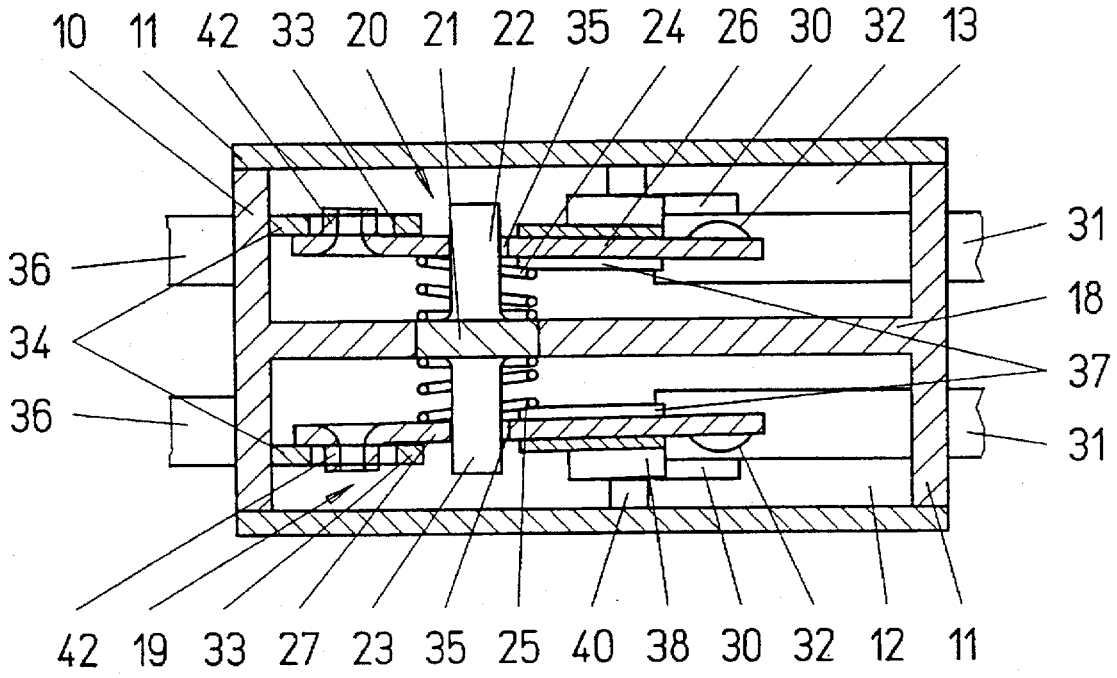
FIG. 3 is a sectional view taken on section line III—III in FIG. 2.

FIG. 1 is a basic illustration of a first illustrative embodiment of the invention comprising a housing 10, in which, as is shown in FIG. 3, the coverlike front wall 11 of the housing has been omitted to expose the interior of a front chamber 12 of the housing. As is also apparent from FIG. 3 the housing 10 comprises two closed housing chambers 12 and 13.

As is shown in FIG. 1 the housing chambers 12 and 13 comprise a common right-hand side wall 14, a common left-hand side wall 15, a common bottom wall 14, and a common top wall 17. The walls 14 to 17 are integral with a partition wall 18 and consist of an insulating plastic.

The front housing chamber 12 accommodates a change-over switch 19. The rear housing chamber 13 accommodates a change-over switch 20 for disconnecting the electric motor from the associated power source. The change-over switches 19 and 20 serve to connect and disconnect the electric motor to and from an associated power source, for reversing the polarity of a field winding or armature winding of the electric motor, and for enabling and disabling an electric braking circuit and are symmetrically arranged with respect to the partition wall 18. They are actuated in unison by a switching slider 21, which extends through the top wall 17 and is guided in the partition wall 18. The switching slider 21 is provided adjacent to its lower end with pins 22 and 23, which protrude at right angles on both sides and are surrounded each by a contact pressure spring 24 or 25, which is supported by the switching slider 21. The contact pressure spring 24 biases a pivoted lever 26 of the change-over switch 20. The contact pressure spring 25 biases a pivoted lever 27 of the change-over switch 19.

Figure 2:
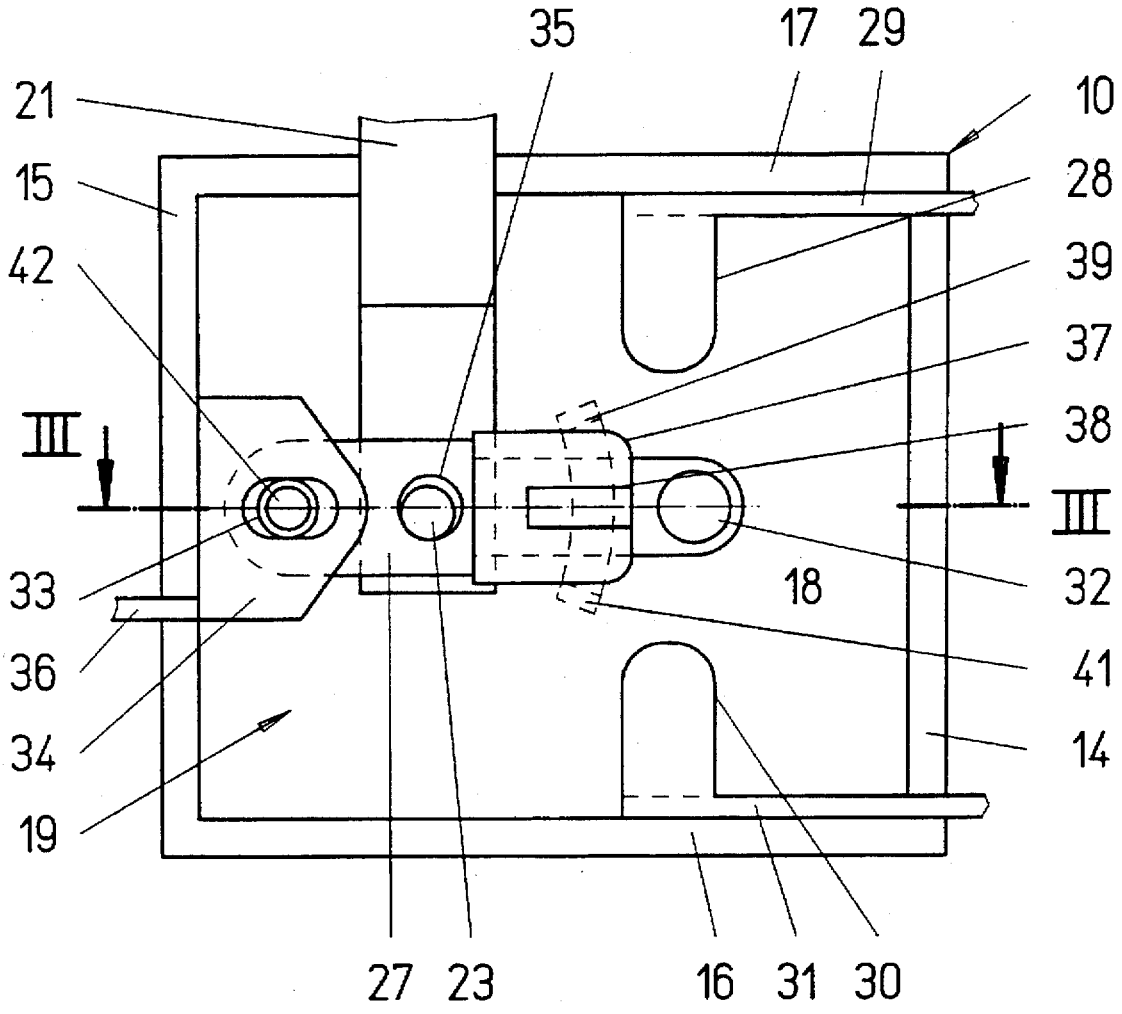
FIG. 2 shows the device of FIG. 1 with the movable contact in an intermediate position.

As is best apparent from FIG. 2 the change-over switch 19 comprises a fixed OFF contact 28, which is connected to a conductor 29 extending through the side wall 14 to the outside of the housing 10. Adjacent to the bottom wall 16 a fixed ON contact 30 is provided, which is connected to an electric conductor 31, which also extends through the side wall 14 out of the housing 10. The pivoted lever 27 is provided at its free end with a lateral contact 32, which by movements of the pivoted lever 27 can be contacted either with the OFF contact 28 or with the ON contact 30. By means of a hinge 42, which provides for a backlash, the pivoted lever 27 is movably mounted in a slot 33 of a terminal tab 34 in such a manner that the movable contact 32 is movable also at right angles to the plane in which the pivoted lever 27 is pivotally movable so that the movable contact can be disengaged and lifted from the fixed contact. For this reason the pivot pin 23 is also mounted with a backlash in an oversize bore 35 of the pivoted lever 27. An electric conductor 36 extends from the terminal tab 34 through the wall 15 to the outside of the housing 10.

In a region between the bore 35 and the end contact 32 the pivoted lever 27 is provided with an attached plastic part 37, which is integrally formed with a sliding rib 38, which protrudes at right angles toward the front wall 11 and which in the position shown in FIG. 2 is urged by the contact pressure spring 25 against an arcuate sliding rib 40. In FIGS. 1 and 2, the sliding rib 40 is shown to be provided with cam faces 39 and 41, which are indicated by broken lines and during the pivotal movement of the pivoted lever 27 force the sliding rib 38 away from the plane of the sliding rib 40 until the movable contact 32 contacts the fixed contact 28 or 30. The cam faces 39 and 41 may be constituted by 45° ramps or by transition curves.

For initiating an electric braking of an electric motor the device can be actuated from the position shown in FIG. 1. To that end the switching slider 21 is pushed into the housing 10 in the direction of the arrow indicated in FIG. 1. During a pivotal movement of the pivoted lever 27 over a certain range, this will result in a lateral displacement involving a wiping movement between the contacts 32 and 28 until the sliding rib 38 reaches the cam face 39. For a switching movement the movable contact 32 is quickly raised to the plane of the sliding rib 40 to ensure a reliable separation of the contacts. As the pivotal movement of the pivoted lever 27 is continued, the sliding rib 38 reaches the cam face 41 so that the movable contact 32 is then moved in sliding contact with the fixed contact 30 until the final position is reached, which is indicated by broken lines in FIG. 1.

The change-over switch 20 is designed as a mirror image of the change-over switch 19 but for functional reasons the connections to its fixed contacts are interchanged.

It is apparent that the device in accordance with the invention desirably permits large contact clearances, the use of wiping contacts, and an assembly comprising simple components, which can easily be manufactured and assembled.

Figure 4:
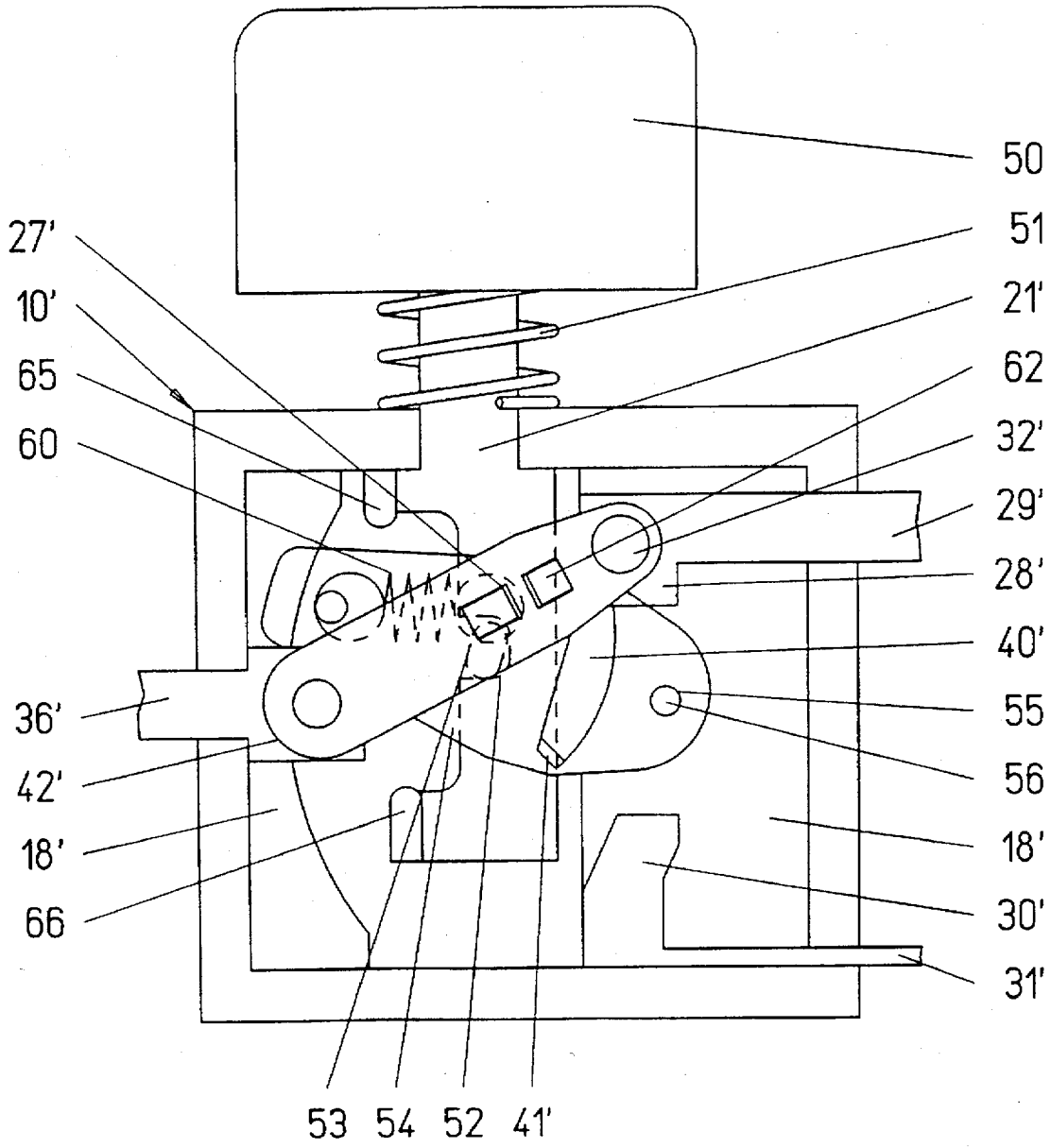
FIG. 4 is a partly schematic representation of a second device in accordance with the invention in a position in which an electric motor disconnected from an associated electric power source.
Figure 7:
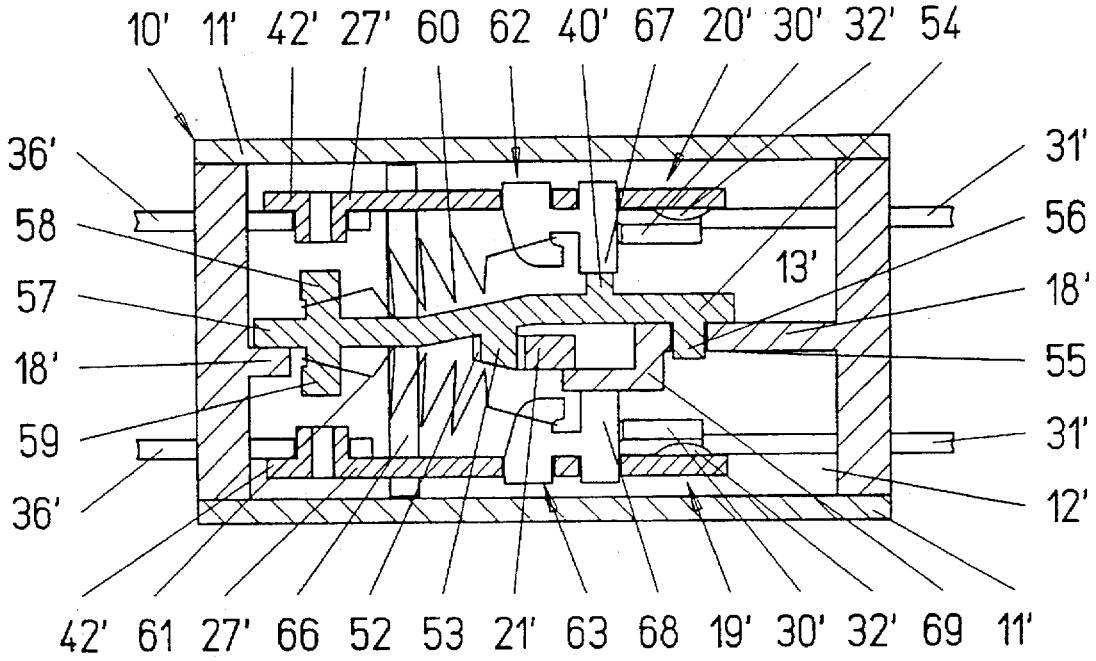
FIG. 7 is a sectional view taken on line VII—VII in FIG. 6 with the movable contact and the toggle lever shown in their intermediate position.

A second illustrative embodiment of a device in accordance with the invention is shown in FIGS. 4 and 7 and comprises a housing 10' and a modified switching slider 21', which comprises an integrated button and is provided with a compression spring. Those parts of said second illustrative embodiment which are identical or similar to parts of the first illustrative embodiment are designated for the sake of simplicity with the same reference characters as in the first illustrative embodiment but with a prime. In order to avoid repetition, only the differences from the first illustrative embodiment will be described hereinafter with respect to the second illustrative embodiment. Modified components will be designated by primed reference characters.

The second illustrative embodiment differs from the first essentially by the fact that each of the change-over switches 19' and 20' will always be either in a stable ON position or in a stable OFF position. On the other hand, the change-over switches 19 and 20 of the first illustrative embodiment permit the movable contact 32 and the associated pivoted lever 27 to assume also intermediate positions.

Figure 6:
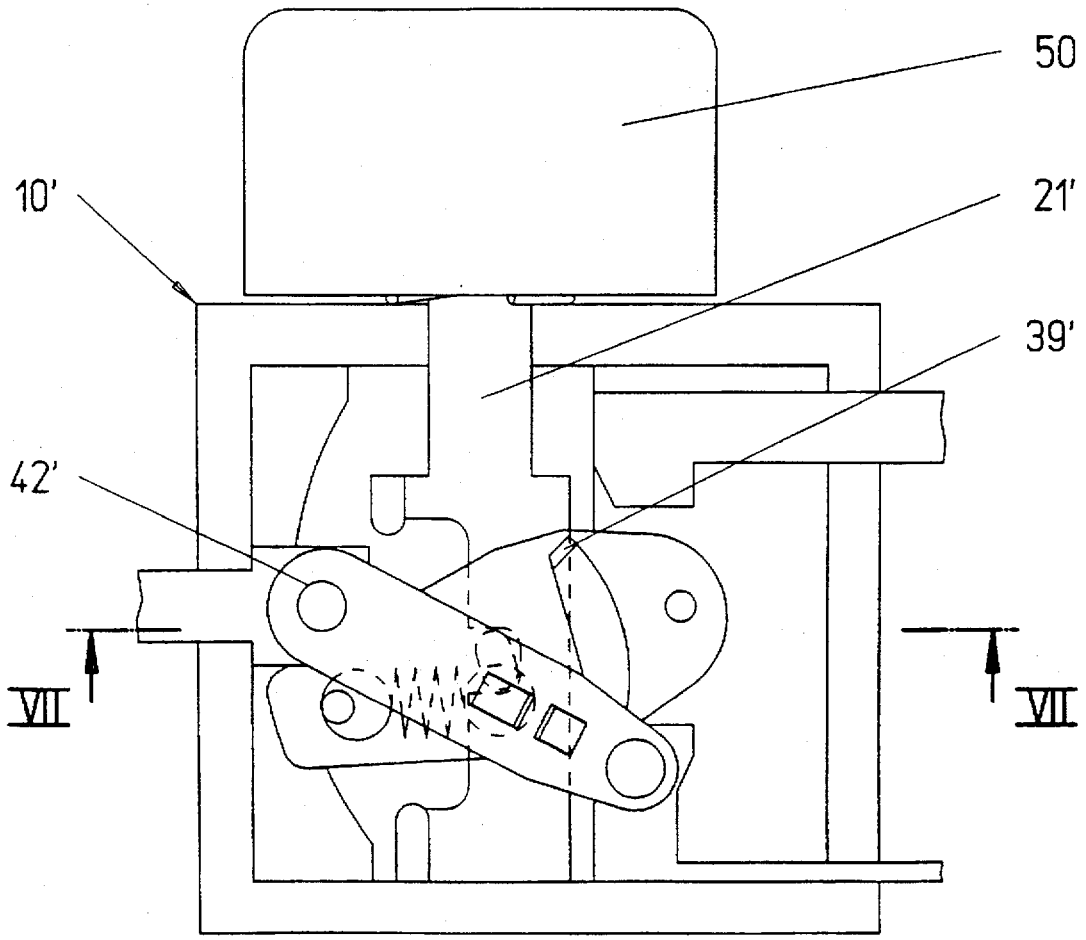
FIG. 6 shows the device of FIG. 4 in a position in which an electric motor is connected to an associated electric power source.

The switching slider 21' is provided at its top end with an actuating button 50, which is supported on the housing 10' by a compression spring 51 for resetting the switching slider 21'. As is apparent from FIG. 7 the switching slider is guided adjacent to the partition wall 18' of the housing 10'. The switching slider 21' comprises a groove-like recess 52 for pivotally mounting a pin 53, which is laterally formed on or secured to a toggle lever 54. The toggle lever 54 is pivoted at 55 (see also FIG. 7) to the partition wall 18' by means of a lateral pin 56 and is pivotally movable between the positions shown in FIGS. 4 and 6, respectively. Its position shown in FIG. 4 is associated with the OFF position and its position shown in FIG. 6 is associated with the ON position of the change-over switches 19' and 20'.

Figure 5:
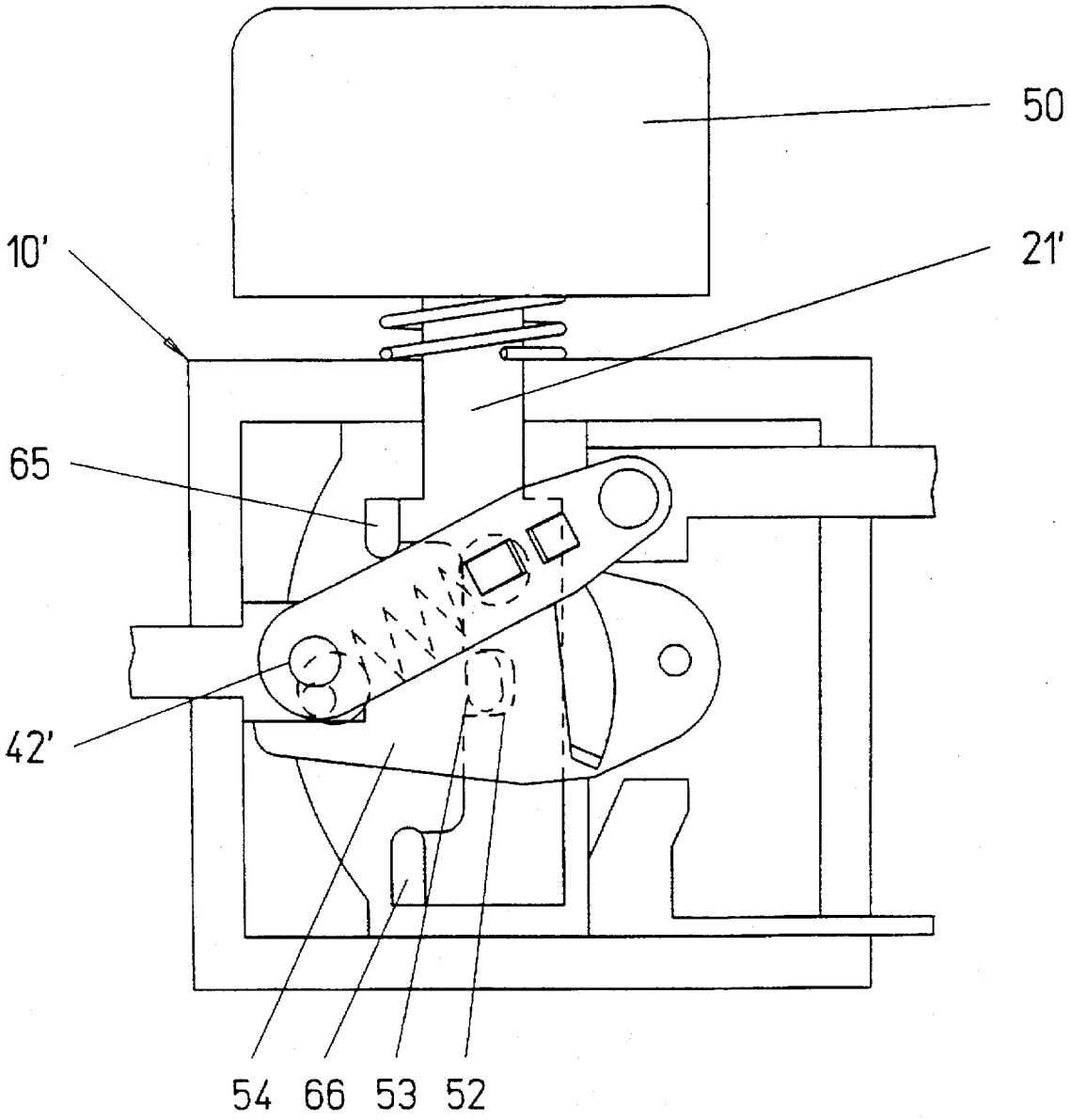
FIG. 5 shows the device of FIG. 4 with the toggle lever in an intermediate position.

The toggle lever 54 has a forward end 57, which laterally engages and is guided by a portion of the partition wall 18'. The partition wall 18' is open in the range in which the toggle lever 54 is pivotally movable. Adjacent to the forward end 57 of the toggle lever 54 the latter is provided on both sides with pins 58 and 59, on which respective inclined tension springs 60 and 61 are hung, which extend from there outwardly at an angle of about 15° toward the movable contacts 32'. At their other end the tension springs 60 and 61 are hung on respective plastic parts 62 and 63, which are secured to the pivoted levers 27' associated with the respective movable contacts 32'. The lines of action of the springs 60 and 61 and their initial tension reliably ensure a desired contact pressure in the stable positions of the switch. On the other hand the springs 60 and 61 serve to impart the switching movements to the movable contacts 32'. This is effected in that, after the switching slider 21' has been depressed, the movable contact 32' will initially remain in its current contact position until the pivotal movement of the toggle lever 54 has further extended the tension springs 60, 61 and has angularly moved their lines of action beyond the neutral position in which they are directed toward the hinge 42'. This results in the exertion of a turning moment which is sufficient to overcome the friction between the contacts and causes the movable contact 32' to jump to the second stable position immediately. Because a welding or sticking of the contacts may have the result that the springs cannot exert a sufficiently strong force, the switching slider 21' is provided with two mutually opposite contact-breaking lugs 66, which in the OFF position and in the ON position of the switches are spaced apart form the pivoted lever 27' associated with the movable contact 32' and, as shown in FIG. 5, will engage the pivoted levers 27', to break the contacts only when the toggle lever 54 has approximately reached its intermediate position.

The plastic part 62 which serves to retain the springs and to guide the movement of the movable contact 32' is integrally formed with a pin 67, which during the switching operation is guided by a sliding rib 40', which is integrally formed on the toggle lever 54. Just as the sliding rib 40 of the first illustrative embodiment the sliding rib 40' is provided with cam faces 41' and 39', which act as described hereinbefore.

The plastic part 63, which serves to retain the springs and to guide the movement of the movable contact 32', comprises an inwardly directed pin 68, which in the second illustrative embodiment is slidingly guided on a wall portion 69, as shown in FIG. 7. The wall portion 69 serves also to guide the switching slider 21'. Alternatively it is possible also in this case to provide on the wall 69 a sliding rib 40' for cooperating with the pin 68 so that the movements performed by both pivoted levers 27' and the movable contacts 32' during the switching operation will be mirror images of each other.

We claim:

1. A device for switching an electric motor; comprising:

two change-over switches for connecting and disconnecting an electric motor to and from a power source;

an actuating member for the change-over switches;

one movable contact provided for on each change-over switch, said movable contacts being movable between an ON position and an OFF position, wherein the OFF position is spaced an arcproof distance from the ON position;

means for guiding at least one of the movable contacts at least over a part of its path of movement during the switching operation; and wherein the actuating member is pivotally connected to both movable contacts.

2. A device for switching an electric motor, particularly for electrically braking an electrically operated tool, comprising a switch housing;

two change-over switches for connecting and disconnecting the electric motor to and from a power source, for reversing the polarity of a field winding or armature winding, and for enabling and disabling an electric braking circuit for the electric motor;

an actuating member for the change-over switches;

one movable contact provided for on each change-over switch, each movable contact having a first end and a second end, said first end of said movable contacts being pivotally attached to said housing thereby allowing pivotal movement of said movable contacts in a plane, wherein said second end of said movable contacts is movable between an ON position and an OFF position, wherein the OFF position is spaced an arcproof distance from the ON position; and means for guiding at least one of the movable contacts at least over a part of its path of movement during the switching operation in a lifting movement such that the lifting movement away from the ON position comprises movement at an angle from the plane of the pivotal movement of the movable contacts.

3. A device according to claim 2, wherein the actuating member is connected to each movable contact by a spring.

4. A device according to claim 3, wherein said at least one movable contact is arranged to be lifted against the action of a contact pressure spring by the guiding means from a fixed contact previously engaged by said movable contact, after said movable contact has performed a wiping movement on said fixed contact.

5. A device according to claim 2, wherein the actuating member is linked to a toggle lever, which is connected to each movable contact by a spring.

6. A device according to claim 2, wherein each guiding means comprises a sliding guide for the movable contact and said sliding guide is limited by cam faces.

7. A device according to claim 2, wherein each movable contact is laterally provided on a pivoted lever.

8. A device according to claim 2, wherein each movable contact is laterally provided on a pivoted lever, said pivoted lever comprising a plastic part provided with a sliding rib for cooperating with a sliding guide.

9. A device according to claim 2, wherein each movable contact is laterally provided on a pivoted lever, said lever being rotatably mounted with a lateral backlash in a slot.

10. A device according to claim 2, wherein the actuating member is linked to a toggle lever, which is connected to each movable contact by a spring, the toggle lever being formed with at least one sliding guide for the movable contact.

11. A device according to claim 2, wherein each guiding means comprises a sliding guide for the movable contact and said sliding guide is limited by cam faces, at least one sliding guide for a pivoted lever being provided on a wall of a housing for the change-over switches.

12. A device according to claim 2, wherein the two change-over switches are symmetrically arranged in a single housing in separate chambers.

13. A device according to claim 2, wherein the actuating member consists of a switching slider.

14. A device according to claim 2, wherein the actuating member is linked to a toggle lever, which is connected to each movable contact by a spring, and wherein the actuating member consists of a switching slide, said switching slider being provided with two mutually opposite contact-breaking ribs, which in the OFF position and in the ON position of the switch are respectively spaced from the movable contact.

15. A device according to claim 2, wherein each movable contact is laterally provided on a pivoted lever, each pivoted lever being provided with a spring-retaining and movement-guiding part.

16. A device according to claim 2, wherein at least one movable contact is arranged to be lifted against the action of a contact pressure spring by the guiding means from the fixed contact previously engaged by said movable contact, after said movable contact has performed a wiping movement on said fixed contact, said contact pressure springs being arranged between the associated movable contacts and the switching slider or the toggle lever.

17. A device according to claim 2, wherein the actuating member consists of a switching slider, said switching slider being movably mounted in the housing adjacent to a wall by which the two housing chambers containing the change-over switches are separated.

18. A device for switching electric power on and off, comprising:

a switch housing;

at least one lever having a first end and a second end, said first end being pivotally attached to said housing and said second end including a first contact;

a switching slider slidably guided in said housing, said switching slider being pivotally attached to said at least one lever whereby sliding movement of said slider causes said at least one lever to pivot in a plane defined by said switching slider and said lever;

a second contact attached to said switch housing electrically contactable by said first contact at a first position; and wherein said at least one lever is movable at an angle to said pivot plane to disengage and lift the first contact from the second contact.

19. A device as in claim 18, wherein said at least one lever is movable at a right angle from the pivot plane thereby causing an increased arcproof distance between the contacts.

20. A device as in claim 18, wherein said switching slider is pivotally attached to said at least one lever at a position between said first end and said second end of said at least one lever.

21. A device as in claim 18, further comprising a third contact for electrically conductive contact with said first contact at a second position of said at least one lever.

22. A device as in claim 18, wherein said at least one lever is attached to said housing through an electrically conductive hinge, said hinge electrically connecting said at least one lever to an electric conductor extending from said switch housing.

23. A device as in claim 18, wherein said at least one lever comprises two levers for switching two different electrical connections.

24. A device as in claim 18, wherein said switching slider is movable relative to the housing such that in case said second end of said at least one lever is in a fused connection with said second contact, a sliding movement of said switching slider causes said first end of said at least one lever to pivot to break the fused connection.

* * * * *